US006776363B1

(12) United States Patent
Falletta et al.

(10) Patent No.: US 6,776,363 B1
(45) Date of Patent: Aug. 17, 2004

(54) CARRIAGE ATTACHMENT FOR A POWER WASHER

(76) Inventors: Nicholas J. Falletta, 52744 Westgate Dr., South Bend, IN (US) 46635; Joseph J. Falletta, 21 Washington St., Lancaster, NY (US) 14086; Jim Welker, 61472 State Rd. 331, Mishawaka, IN (US) 46544

( * ) Notice: Subject to any disclaimer, the term of this patent is extended or adjusted under 35 U.S.C. 154(b) by 0 days.

(21) Appl. No.: 10/425,238

(22) Filed: Apr. 30, 2003

(51) Int. Cl.[7] ..... B05B 3/00

(52) U.S. Cl. ..... 239/722; 239/754; 239/525; 239/375; 239/280

(58) Field of Search ..... 239/722, 532, 239/525, 375, 280, 754, 550; 222/529, 608; 15/321, 329, 333, 335; D32/15

(56) References Cited

U.S. PATENT DOCUMENTS 1,724,702 A * 8/1929 Flickinger ..... 239/723
2,595,933 A * 5/1952 Gilbertsen ..... 239/754
2,746,072 A * 5/1956 Lumpkin ..... 401/48
3,158,892 A * 12/1964 Bridger et al. ..... 401/219
3,931,931 A * 1/1976 Otis ..... 239/754

FOREIGN PATENT DOCUMENTS

GB 1377380 * 12/1974 ..... 239/722

* cited by examiner

*Primary Examiner*—Dinh Q. Nguyen
(74) *Attorney, Agent, or Firm*—R. Tracy Crump

(57) ABSTRACT

The carriage attachment includes a sheet metal frame bent to have a flat deck and angled splash guard. Two wheels are mounted on either side of the carriage frame. A spray nozzle is fitted underneath the carriage deck and a quick release coupling is used to connect the carriage attachment to the wand of a power washer. The wheels can be mounted to the carriage frame at different positions to adjust the height of the nozzle over the surface being cleaned. The carriage attachment allows the operator to maintain an upright posture while cleaning ground surfaces using a relaxed sweeping motion. The carriage attachment reduces operator fatigue by allowing the operator to simply guide the movement of the carriage attachment over the surface without having to stabilize the extension wand under the force of the pressurized water stream.

5 Claims, 3 Drawing Sheets

CARRIAGE ATTACHMENT FOR A POWER WASHER

This invention relates to power washers and in particular, a carriage attachment for a power washer.

BACKGROUND OF THE INVENTION

Modern power washers are convenient tools for a variety of cleaning tasks, such as, cleaning debris and leaves from decks, patios, sidewalks, driveways, floors and other flat ground surfaces. Power washers generate a powerful pressurized jet of water that blast away leaves, dirt and debris from cracks, corners and edges and the rough surfaces of pavement, concrete, brick and tile. Power washers generally include a spray nozzle fitted to an elongated extension wand. The operator grasps the wand and directs the water stream from the nozzle onto the surface to be cleaned. The force of the pressurized water stream expelled from the spray nozzle at the end of the extension wand generates a torque on the wand that gives the operator some resistance to manipulating the wand. Consequently, the operator must have a firm grip on the extension wand and must often use two hands to hold the wand. Furthermore, fighting the torque on the wand quickly leads to operator fatigue.

A water broom attachment has been developed by DeVilbiss Air Power Company of Jackson Tennessee for power washers. This attachment is used for cleaning floors, pavement and other ground surfaces. The attachment comprises a manifold that feeds three spray nozzles. The manifold connects to the extension wand and has two caster wheels that allows the attachment be used like a broom with the manifold riding over the surface on the casters. The water broom attachment has several practical shortcomings. The multiple nozzle/manifold design divides the pressurized water flow into several weaker water streams. While the manifold rides on two casters, the casters do not provide much support for the operator. Since the manifold rides on casters, the operator has to support the extension wand at a certain attitude to properly direct the water stream from the nozzles. The attitude and height of the nozzle with respect to the surface can not be adjusted because the nozzles are fixed to the manifold and the manifold sits at a fixed height atop of the caster. The operator must alter his posture or hold the wand at a different attitude in order to adjust the orientation of the water stream. The multiple nozzle/manifold design is also relatively expensive. The manifold body is generally an extruded tubal channel. Bores are tapped in the channel, into which the nozzles are threaded. Since the water flow is under pressure, the machining of the bores and taps in the manifold must be precise to avoid leaking.

Given the shortcomings of conventional water brooms, there is still a need for a power washer attachment that can be used to clean floors, pavement and other ground surfaces that reduces operator fatigue and can be manipulated with ease. Ideally, such an attachment would connect to conventional wands and position the spray nozzle close to the ground. Furthermore, such an attachment would allow the operator to use the attachment over the ground in a natural upright posture and manipulate the attachment using only one hand.

SUMMARY OF THE INVENTION

The carriage attachment of this invention is used with a conventional power washer and allows the operator to maintain an upright posture while cleaning ground surfaces using a relaxed sweeping motion. The wheeled carriage attachment mounts to the extension wand of any conventional power washer and rides over the surface being cleaned as the pressurized water stream blast dirt and debris from the surface. The carriage attachment reduces operator fatigue by allowing the operator to simply guide the movement of the carriage attachment over the surface without having to stabilize the extension wand under the force of a pressurized water stream.

The carriage attachment includes a sheet metal frame bent to have a flat deck and angled splash guard. Two wheels are mounted on either side of the carriage frame. A spray nozzle is fitted underneath the carriage deck and a quick release coupling is used to connect the carriage attachment to the wand of a power washer. The wheels can be mounted to the carriage frame at different positions to adjust the height of the nozzle over the surface being cleaned. The carriage attachment has a compact design that allows the attachment to work in tight corners and the shape of the carriage frame shields the operator from the water stream.

Accordingly, an advantage of the carriage attachment of this invention is that it allows the operator to maintain an upright posture and reduces operator fatigue.

Another advantage of this invention is that the operator does not have to stabilize the wand but simply move it back and forth over the ground surface.

Another advantage of this invention is that the carriage attachment maintains the spray nozzle at proper height and attitude to the surface being cleaned.

Another advantage of this invention is that the carriage attachment has a simple but rugged design that makes it durable and easy to use and operate.

Another advantage of this invention is that the carriage attachment employs a quick connect couple so that the attachment can be quickly connected or disconnected to the extension wand without additional tools or fasteners.

Another advantage of this invention is that the nozzle height can be readily adjusted by repositioning the wheels on the carriage frame.

Another advantage of this invention is that the carriage frame is shaped to direct the water stream forward and shield the operator from the water stream.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to best explain the invention so that others skilled in the art might utilize its teachings.

Figure 1:
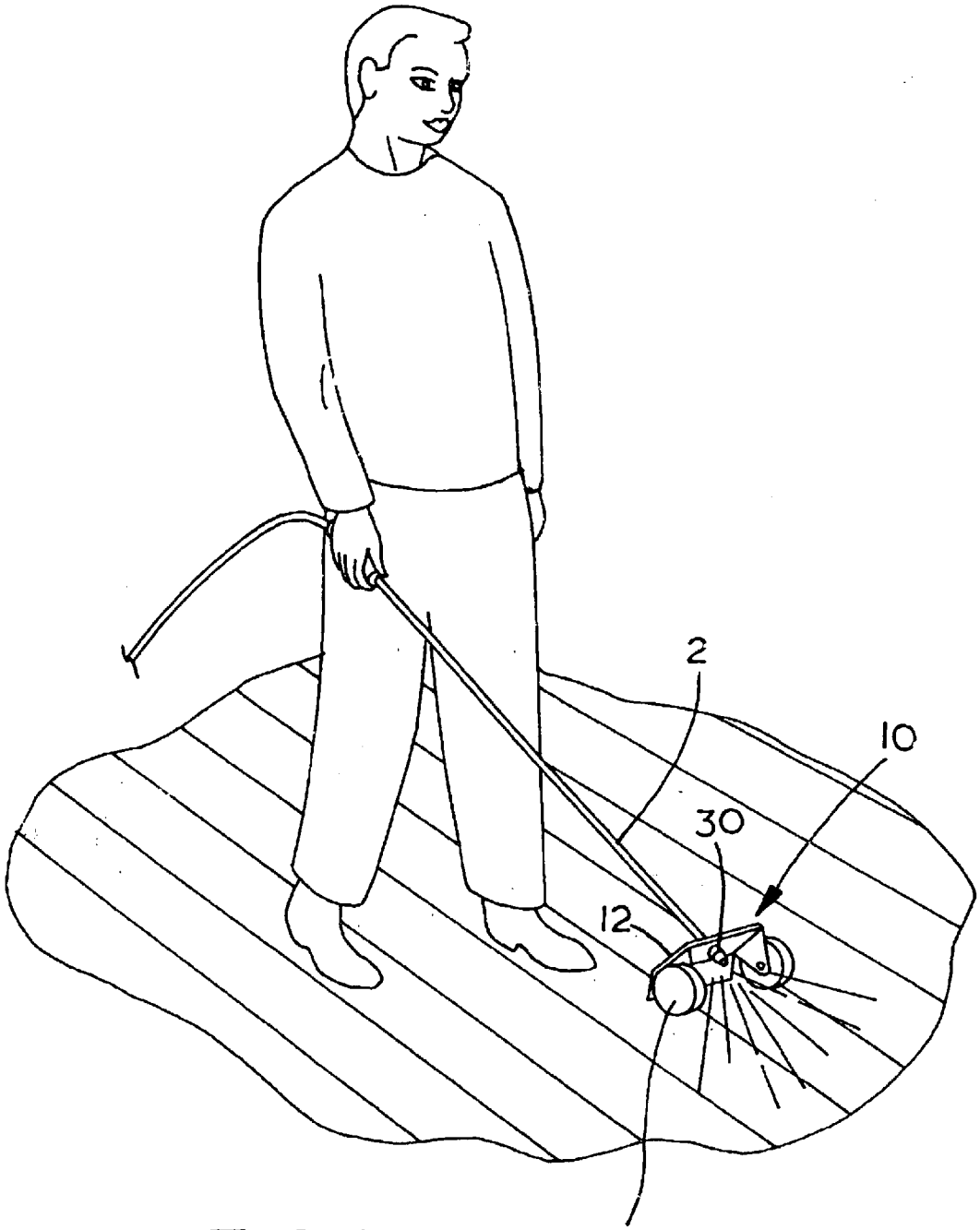
FIG. 1 is a perspective view of a person using the trolley attachment of this invention connected to the wand of a conventional power washer.

FIG. 1 shows the carriage attachment of this invention designated generally as reference numeral 10. As shown, carriage attachment 10 is connected to the distal end of the extension wand 2 of a conventional power washer (not shown). The design, components and operations of power washers are well known in the art. Carriage attachment 10 allows the operator to maintain an upright posture while cleaning ground surfaces using a relaxed sweeping motion.

Figure 2:
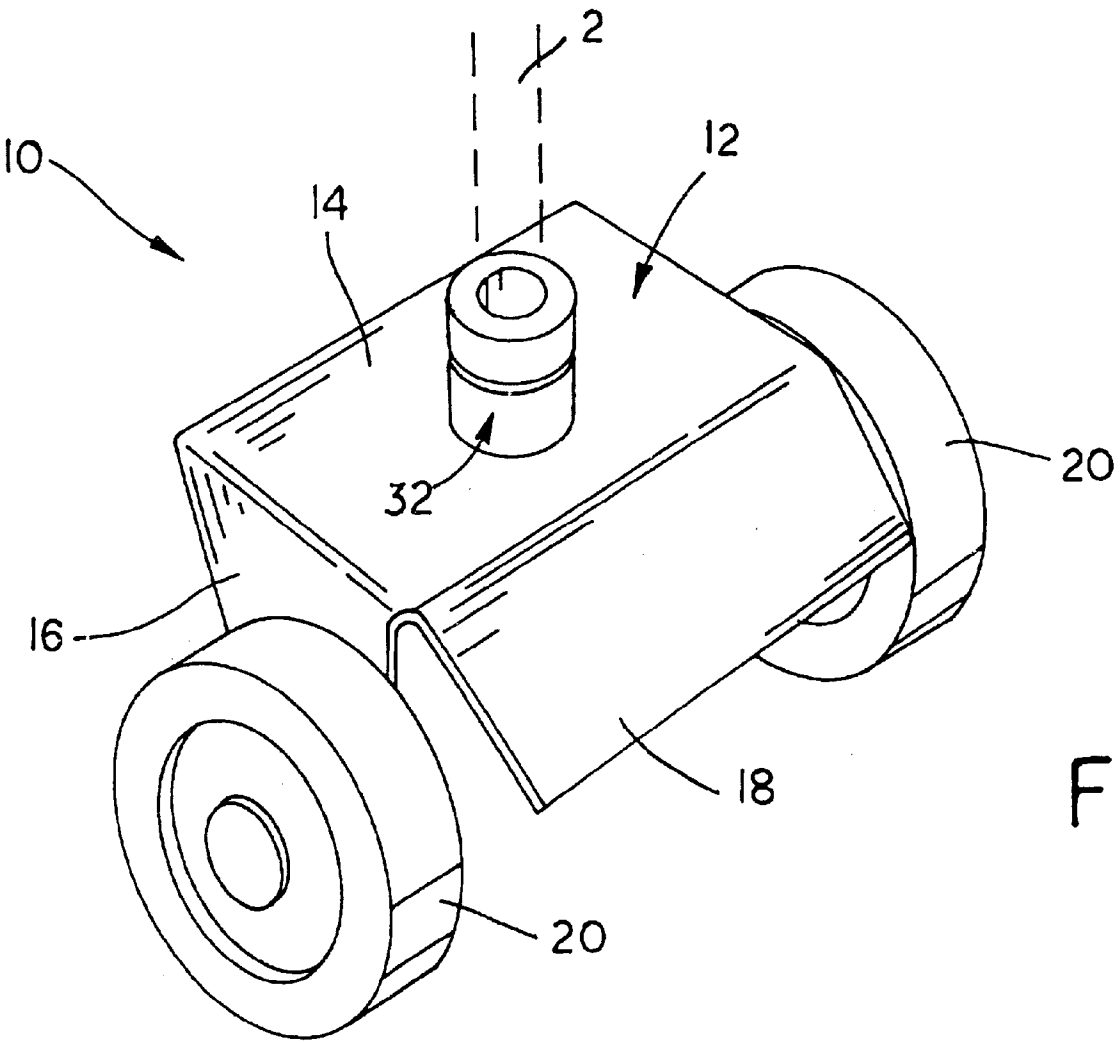
FIG. 2 is a perspective view of the trolley attachment of this invention.

Carriage attachment 10 includes a carriage frame 12, two wheels 20, a nozzle 20 and a wand coupling 32. Carriage frame 12 is constructed from a flat sheet of metal that is cut and bent into the form best shown in FIGS. 2 and 3. Carriage frame 12 is bent to from a flat deck 14, two spaced ears 16 and a rear splash guard 18. Splash guard 18 is angled slightly downward with respect to deck 14. Ears 16 are spaced apart and extend downward from the sides of deck 14. Each ear 16 has three aligned holes 17. Wheels 20 are mounted to carriage frame 12 by two axle pins 22. Axle pins 22 extend through one of the three ear holes 17 and are secured to ears 16 by a hex nut 24 that is turned onto the thread end of the axle pin. Wheels 20 can be mounted to carriage frame 12 in any of the three aligned holes 17 to provide three different height adjustments for the spray nozzle 30. As shown, spray nozzle 30 is mounted to the underside of deck 14 and wand coupling 32 is mounted to the topside of deck 14. Coupling 32 has a conventional quick release fitting design that allows quick connect and disconnect from a fitting on the end of extension wand 2. Coupling 32 communicates the pressurized water flow from extension wand 2 to spray nozzle 30.

Figure 3:
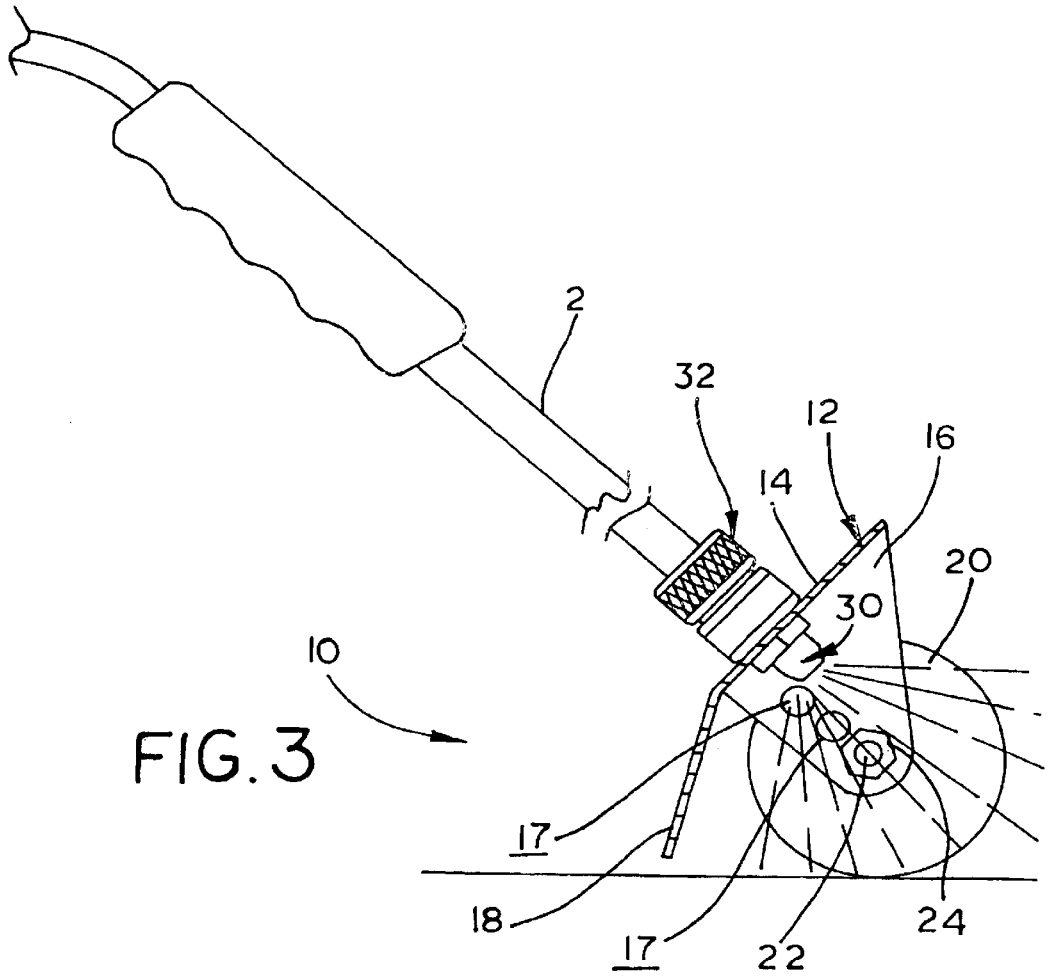
FIG. 3 is a side sectional view of the trolley attachment of FIG. 2 connected to the wand of a conventional power washer.

FIG. 1 illustrates the use of carriage attachment 10 on extension wand 2. As depicted, the operator guides the wand to move carriage attachment 10 back and forth in a sweeping motion. Carriage attachment 10 rides along the ground and the pressurized water stream blast dirt and debris forward away from the operator. As best shown in FIG. 3, deck 14 is angularly oriented to the surface being cleaned and splash guard 18 is substantially perpendicular to the surface being cleaned. Also, spray nozzle 30 directs the pressurized water stream downward substantial perpendicular to the deck 14.

Advantages

One skilled in the art will note several advantages of the carriage attachment of this invention over conventional water broom attachments for power washers. The carriage attachment allows the operator to maintain an upright posture while cleaning ground surfaces using a relaxed sweeping motion. The carriage attachment rolls over the ground surface and maintains the spray nozzle at proper height and attitude during the sweeping motion. The operator does not have to stabilize the wand but simply move it back and forth over the ground surface. The carriage rides easily over the surface being cleaned and can be guided and moved readily with one hand. The carriage isolates the operator from the force of the pressurized stream. Consequently, the carriage attachment reduces operator fatigue and speeds the cleaning process.

The carriage attachment has a simple but rugged design that makes it durable and easy to use and operate. The coupling allows the carriage attachment to be quickly connected or disconnected to the extension wand without additional tools or fasteners. The nozzle height can be readily adjusted by repositioning the wheels on the carriage frame. The carriage frame is shaped to direct the water stream forward and shield the operator from the water stream. The compact shape of the carriage attachment allows it to be guided into tight corners.

It is understood that the above description does not limit the invention to the details given, but may be modified within the scope of the following claims.

We claim:

1. An attachment used with a power washer having an elongated extension wand, the attachment for cleaning a substantially horizontal surface and comprising:

a carriage frame; a pair of wheels; a spray nozzle; and means coupled to the spray nozzle for connecting the attachment to the extension wand, the carriage frame includes a planar deck having a top and bottom, a pair of spaced ears extending from the deck bottom, and a splash guard angled from the deck between the pair of ears, the spray nozzle mounted to the deck bottom and the connecting means mounted to the deck top, the pair of wheels are mounted to the carriage frame at selective positions to adjust the height of the spray nozzle with respect to the substantial horizontal surface.

2. The attachment of claim 1 wherein the pair of ears each having a plurality of holes therein, the pair of wheels each having an axle part extending through one of the plurality of holes in one of the pairs of ears.

3. In combination, a power washer and an attachment for cleaning a substantially horizontal surface, the power washer including an extension wand, the attachment comprising:

a carriage frame; a pair of wheels; a spray nozzle; and a fitting coupled to the spray nozzle and connecting the attachment to the extension wand, the carriage frame includes a planar deck having a top and bottom, a pair of spaced ears extending from the deck bottom, and a splash guard angled from the deck between the pair of ears, the spray nozzle mounted to the deck bottom and the connecting means mounted to the deck top, the pair of wheels are mounted to the carriage frame at selective positions to adjust the height of the spray nozzle with respect to the substantial horizontal surface.

4. The attachment of claim 3 wherein the pair of ears each having a plurality of holes therein, the pair of wheels each having an axle part extending through one of the plurality of holes in one of the pairs of ears.

5. An attachment used with a power washer having an elongated extension wand, the attachment for cleaning a substantially horizontal surface and comprising:

a carriage frame, the carriage frame includes a planar deck having a top and bottom, a pair of spaced ears extending from the deck bottom with each having a plurality of holes therein, and a splash guard angled from the deck between the pair of ears;

a pair of wheels mounted to the carriage frame with each of the pair wheels having an axle part extending through one of the plurality of holes in one of the pair of ears;

a spray nozzle; and fitting coupled to the spray nozzle for connecting the attachment to the extension wand.

* * * * *